US007575467B2

(12) United States Patent
Ferguson et al.

(10) Patent No.: US 7,575,467 B2
(45) Date of Patent: Aug. 18, 2009

(54) ELECTRICALLY SAFE RECEPTACLE

(76) Inventors: Thomas Wilmer Ferguson, 54861 High Ridge Rd., Bellaire, OH (US) 43906; Gregory W. Veith, 416 Saw Mill Ct., Norristown, PA (US) 19401

( * ) Notice: Subject to any disclaimer, the term of this patent is extended or adjusted under 35 U.S.C. 154(b) by 52 days.

(21) Appl. No.: 11/616,798

(22) Filed: Dec. 27, 2006

(65) Prior Publication Data

US 2008/0160810 A1 Jul. 3, 2008

(51) Int. Cl.
*H01R 3/00* (2006.01)

(52) U.S. Cl. ..... 439/489; 439/188; 439/955

(58) Field of Classification Search ..... 439/38, 439/188, 489, 955; 200/51.09, 51.1
See application file for complete search history.

(56) References Cited

U.S. PATENT DOCUMENTS

| | | | | |
|---|---|---|---|---|
| 2,500,474 | A | 3/1950 | Sperrazza | |
| 3,854,125 | A * | 12/1974 | Ehling et al. | 714/27 |
| 3,942,856 | A | 3/1976 | Mindheim | |
| 4,008,403 | A | 2/1977 | Rose | |
| 4,093,336 | A | 6/1978 | Rose | |
| 4,148,536 | A | 4/1979 | Petropoulsos | |
| 4,152,557 | A | 5/1979 | Busch | |
| 4,179,175 | A | 12/1979 | Farnworth | |
| 4,271,337 | A | 6/1981 | Barkas | |
| 4,591,732 | A | 5/1986 | Neuenschwander | |
| 4,758,696 | A | 7/1988 | Grazer | |
| 4,853,823 | A | 8/1989 | Arechavaleta | |
| 4,915,639 | A | 4/1990 | Cohn | |
| 4,927,373 | A | 5/1990 | Dickie | |
| 4,995,017 | A | 2/1991 | Sellati | |
| 5,069,632 | A | 12/1991 | Avitan | |
| 5,113,045 | A | 5/1992 | Crofton | |
| 5,151,841 | A * | 9/1992 | Knights | 361/86 |
| 5,186,639 | A | 2/1993 | Comerci | |
| 5,256,076 | A | 10/1993 | Hamlin | |
| 5,320,545 | A | 6/1994 | Brothers | |
| 5,347,095 | A | 9/1994 | Zeder | |
| 5,374,199 | A | 12/1994 | Chung | |
| 5,378,165 | A | 1/1995 | Comerci | |
| 5,530,431 | A | 6/1996 | Wingard | |
| 5,600,306 | A | 2/1997 | Ichikawa | |
| 5,625,345 | A | 4/1997 | Stark | |
| 5,708,551 | A | 1/1998 | Bosatelli | |
| 5,800,189 | A | 9/1998 | Ahmed | |
| 5,865,635 | A | 2/1999 | Hsiang | |

(Continued)

FOREIGN PATENT DOCUMENTS

| | | |
|---|---|---|
| EP | 0621659 A1 | 10/1994 |
| WO | WO8911747 A1 | 11/1989 |

*Primary Examiner*—James Harvey

(57) ABSTRACT

An electrically safe receptacle that in it's normal quiescent state will not have electrical current flow. Said electrically safe receptacle will be equipped with normally-open switches on one or both female conductors that are controlled by a strategically placed sensor to detect the insertion of a male plug. Detection of the male plug insertion will signal the normally open switches to close the circuit pathway and allow for the flow of electrical current to the device permitting normal operation. Insertion of a foreign conductive device such as a hair pin, knife blade, or metallic tool in one or both female conductors will fail to activate the sensor and thereby reduce or eliminate the possibility of accidental electrocution by preventing the flow of electrical current.

6 Claims, 2 Drawing Sheets

U.S. PATENT DOCUMENTS

| | | | | |
|---|---|---|---|---|
| 5,928,019 | A | 7/1999 | Chen | |
| 6,111,210 | A | 8/2000 | Allison | |
| 6,176,718 | B1 | 1/2001 | Skarie | |
| 6,183,264 | B1 | 2/2001 | Harsanyi | |
| 6,229,107 | B1 | 5/2001 | Flint | |
| 6,310,306 | B1 | 10/2001 | Norling | |
| 6,428,334 | B1 | 8/2002 | Skarie | |
| 6,552,888 | B2 | 4/2003 | Weinberger | |
| 6,717,077 | B1 | 4/2004 | Chevarie | |
| 6,749,449 | B2 | 6/2004 | Mortun | |
| 6,984,141 | B1 | 1/2006 | Beski | |
| 7,045,723 | B1 | 5/2006 | Projkovski | |
| 7,070,432 | B1 | 7/2006 | Lin | |
| 2006/0018062 | A1 * | 1/2006 | Wu et al. | 361/42 |
| 2007/0072487 | A1 * | 3/2007 | Gorman | 439/535 |
| 2007/0149013 | A1 * | 6/2007 | Eastham et al. | 439/140 |

* cited by examiner

ELECTRICALLY SAFE RECEPTACLE

FIELD OF INVENTION

In general, this invention relates to electrical wall receptacles. Specifically to wall receptacles designed to reduce or eliminate the possibility of injury by accidental electrocution or shock.

It has been known for many years that electric current is useful and necessary for the operation of many work-saving appliances, and equipment we use everyday. It has also been known for many years that the same characteristics that make electric current useful may—under certain conditions—make it a significant hazard capable of causing injury or death.

In recognition of this hazard, OSHA has established annual safety training requirements for individuals who install or repair and maintain electrical equipment in an industrial environment. These individuals must undergo annual safety training, and the equipment and devices they install must comply with the National Electrical Code.

While professional electricians may be trained to handle electricity with care, individuals who use electrical appliances—and especially young children—are frequently unaware of the potential hazard posed by electric current. As a result of this hazard, numerous efforts have been made to make electrical receptacles safe and childproof.

Most efforts to devise a safer electrical receptacle have concentrated on quickly interrupting a live circuit when a trigger event occurs [typically known as "circuit breakers". The National Electric Code specifies the types of circuit breaker devices that must be used for both residential and commercial systems. Common circuit breakers will open up a live circuit when certain conditions—such as the connection of too many power-consuming devices—are attached to a circuit causing what is commonly known as an overload. Circuit breakers can be reset and operated after the faulty condition has been corrected.

Fuses provide the same protection but must be replaced instead of reset after the occurrence of a trigger event.

GFI—Ground Fault Interrupters—will open a live circuit if leakage current is detected. These devices provide an important degree of safety but are not active until after an electric fault has occurred.

Other devices designed to enhance safety of electrical receptacles include cover plates or locking devices to prevent unintentional access to the live circuit that may kill or injure an individual.

Each of these devices has enhanced the safety of the modern electrical power distribution system, and has reduced the mortality and morbidity of accidental electrical shock, but each has failed to substantially eliminate the risk of accidental electrocution. Notably, all circuit-interrupting devices such as the circuit breakers, fuses, and Ground Fault Interrupters operate only after an electrical shock or fault has occurred. The time interval between when a trigger event is detected and when the circuit is opened is measured in fractions of a second, but these fractions of a second still represent enough time for electrical current to cause death or injury.

Locking devices are effective in an industrial environment where access to electrical circuits is limited to trained individuals that are supposed to utilize "lockout tag out" procedures.

Cover plates are used as a means to prevent children from accidentally inserting a conducting device into a live receptacle but these can act as "attractive nuisances" that attract curious children to pry the protective plate off of the receptacle and insert conducting objects into the circuit causing injury and death.

Several attempts have been made to devise a safer wall receptacle that is not energized until a two or three prong male plug is properly inserted.

DESCRIPTION OF THE RELATED ART

U.S. Pat. No. 6,552,888 Pedro Weinberger

The Weinberger invention is an electrical safety outlet for accepting a plug to provide power to electrical appliances including a power supply and an intelligent circuitry for controlling the power supply to the electrical outlet; the intelligent circuitry includes circuits for determining temperature condition in the outlet, mechanical plug insertion into the outlet, load presence on the outlet, and current capacity conditions.

The strengths of the Weinberger invention are also its' weakness. It is designed to monitor the multiple conditions recited previously at the same time and make go or no go decisions based on programmed criteria. In this sense it most closely resembles a GFI device in both form and function. The multiple task which it is designed to undertake add to the complexity and undermines the reliability.

U.S. Pat. No. 6,428,334 Skarie, et al.

The Skarie device is described as an adaptive/reactive safety plug receptacle which is safe for children yet easy for adults to use. This electrical receptacle provides power only to a properly inserted plug and makes use of one or more sensors which are able to detect blade insertion, ground plug insertion, presence of plug face motion near the receptacle face or a combination thereof. The receptacle includes a contact assembly adapted and configured to conductively couple each blade of the plug to a conductor, one or more sensors, and a control circuit; wherein the control circuit determines whether or not to provide power to the properly inserted plug by determining if simultaneous insertion has occurred.

The Skarie device is in effect a computerized receptacle which relies on sophisticated logic circuits to determine operating conditions and decide if the proper conditions exist for allowance of electrical current.

U.S. Pat. No. 4,271,337 Emanuel Barkas

The Barkas invention is comprised of an electrical receptacle wherein the two electrically conductive female elements are connected to the power source through two normally open switches that are operated by internally positioned mechanical levers that when operated by the insertion of an object will energize the opposite female conductive element. Each mechanical switch lies in a plane between the cover and the female elements of the receptacle whereby insertion of a male plug independently operated the sliding mechanical operators to energize the female elements. Insertion of a conductive object into one female element will close the switch to energize the opposite female element prior to contact of the male plug conductive elements with the female conductive elements this arrangement is designed to reduce arcing at the contacts and at the face of the outlet but does not completely eliminate the arc hazard. Both elements can only be energized by insertion of an object into both openings to the female elements.

There are several problems with the Barkas device that make it impractical. While it does prevent the female elements from causing an electrical shock due to the insertion of a conductive object into either of the female elements, it uses a sliding mechanical switch and a pair of contacts to close the normally open switch that connects the female elements to the power source. The mechanical slide is subject to wear and tear due to the repeated insertion of either a male plug or conductive device. The mechanical slide also closes the contactors by mechanical force, which is slow enough to cause internal arcing at the contactors, and thereby may require frequent replacement of expensive parts.

U.S. Pat. No. 2,500,474 Sperrazza

Sperrazza uses a pair of normally open contact switches wired in series with the female elements that are operated by insertion of the male plug blades into the female openings. The circuit path used by Sperrazza to connect the power to the female elements is through the normally open switches and is oriented in such a way that activation of one switch by insertion of an object through the face of the device into one of the female elements will activate the switch that supplies power to the opposite female element. This crossover arrangement of the circuit path whereby opposite elements are energized prevents accidental electrocution from insertion of electrically conductive foreign objects into a female element.

Normal usage of the Sperrazza device reveals a timing problem with regard to the closure of the switch contacts. Sperrazza tried to eliminate the possibility of an electrical arc at the face of the device by placing the mechanical switch activators sufficiently indented into the device to allow contact of the male plug blades with the female elements prior to the closure of the switch contacts. This solved the problem of face arcing, but the relative slowness of the mechanical closure operation permits arcing at the switch contacts and the subsequent degradation.

A second defect of the Sperrazza device is the preclusion of variable plug blade orientation designs. Sperrazza permits insertion of only non-polarized two prong male plugs, and excludes all other male plug designs such as the three prong grounded plug or two prong polarized plug designs thereby limiting it's usefulness. In addition, Sperrazza uses a long narrow spring device as part of the current carrying elements within the circuit, which not only occupies considerable space, but also generates heat within the device.

U.S. Pat. No. 7,070,432 Lin

A safety socket device includes a base having two conductor bars, and two female contact strips for receiving prongs of plugs. A conductor member and a conductor element are disposed between the conductor bars and each includes two switches located on the sides of the female contact strips, for selectively and electrically coupling to the conductor bars and the female contact strips together. The female contact strips may be electrically coupled to the conductor bars only when the prongs of the plug actuate the four switches simultaneously, to prevent the insertion of foreign objects into the safety socket device by infants and small children.

U.S. Pat. No. 7,045,723 Projkovski

A fail-safe electrical receptacle (1) having normally open switches (6) and normally closed switches (7). The normally open switches (6) are wired to a breaker (11) and are located above the slots (2) and (3) while the normally closed position switches (7) are located below the slots (2) and (3). The contact arms (18) wired to the neutral slot (2) are neutral while the contact arms (10) wired to the hot slot (3) are grounded. If the switch levers (9) and (8) located behind the slots (2) and (3) are pressed against the normally closed switches (7), a circuit is not completed and therefore no power is provided to the outlet. However, if the switch levers (9) or (8) are pressed against the normally open switches (6), the circuit between the hot (3) and the ground (17) or the ground (17) and the hot slot (3) is completed and the breaker (11) is tripped.

U.S. Pat. No. 6,749,449 Mortun, et al.

This is an electrical receptacle, including a power source and a contact for making an electrical connection between the power source and a prong of an electrical plug. At least one switch is in series between the contact and the power source, and a smooth member covers at least a portion of the at least one switch. The switch is normally in the closed position and moves in a direction from the closed position to the open position due to a force applied to the smooth member covering at least a portion of the at least one switch by the prong of the electrical plug when the prong of the electrical plug is inserted into the electrical receptacle and contacts the resilient, smooth member.

U.S. Pat. No. 6,717,077 Chevarie, et al.

This is a safety electrical outlet for receiving metallic prongs of an electrical plug. The outlet includes a housing with at least two plug passages being sized for receiving the metallic prongs of the electrical plug, and two metallic connectors mounted on the housing for connection to an electrical power source. At least two transverse channels communicate with the corresponding plug passages and extend toward the corresponding metallic connectors with at least two spring-biased members being inserted in each corresponding transverse channel and being movable between an extended position where the spring-biased member partially extends within the corresponding plug passage and a retracted position where the corresponding metallic prong that is inserted inside the passage pushes against the spring-biased member so that it touches the corresponding metallic connector for establishing an electrical contact between the metallic prong and the corresponding metallic connector.

U.S. Pat. No. 6,310,306 Norling

A safety wall socket assembly includes housing, a pair of outer switches, a pair of inner contacts, a pair of conductor wires and a pair of interconnection wires. The outer switches are pivotally mounted to the housing and disposed in the respective cavities thereof. The outer switches are biased to a circuit break condition between the conductor wires and interconnection wires and pivotally displaced to a circuit make condition between the conductor wires and interconnection wires in response to partial insertion of the prongs of an electrical plug into the cavities. No electrical connection is established between the outer switches and the prongs of the plug. The inner contacts are mounted to the housing and disposed in the respective cavities thereof spaced inwardly from the outer switches. The inner contacts are biased to a circuit open condition with the interconnection wires and pivotally movable toward a circuit closed condition with the interconnection wires in response to substantially full insertion of the prongs of the electrical plug into the cavities of the housing wherein an electrical interconnection is established between the prongs and electrical current supply, via the inner contacts, the electrical conductor wires and the interconnection wires.

U.S. Pat. No. 6,229,107 Flint, et al.

A safety electrical receptacle is disclosed which eliminates the danger of accidental shock due to inserting a foreign object into the socket of the described device. The safety electrical receptacle body includes cavities and support structures for positioning rotating cams, fixed electrical sockets with integral electrical contacts and movable resilient spring-loaded electrical busses with integral electrical contacts. The contacts remain open and electrically inactive when the receptacle is in the normal unused state with the resilient spring bus displacing the rear cam lobe and positioning the front cam lobe directly into the socket opening. When a plug or other object is inserted into the socket it displaces the front cam lobe and the rear cam lobe moves against the spring-loaded electrical bus and closes the contact on the opposite socket. Conversely, when the mating connector plug is removed from the socket the spring-loaded electrical bus opens the contacts, repositions the cam in the socket opening and the socket is electrically inactive. The described invention is incorporated within the dimensions of a standard type electrical outlet receptacle and renders the outlet safe, in that no voltage is present at the socket of the receptacle unless the proper mating connector plug is fully inserted into each socket. The cover plate of the safety receptacle has visible markings and power indicator lamps to indicate that it is a safety receptacle. The disclosed safety electrical outlet is designed to mate with and be effective with any standard mating connector, whether equipped with a grounding prong or not. The described invention is designed to be manufactured within currently accepted and approved standard dimensions for electrical outlets and electrical enclosures.

U.S. Pat. No. 6,111,210 Allison

An electrical safety outlet is provided and consists of a plug receptacle having typically at least a large neutral blade-slot and a small voltage blade-slot for receiving a large neutral blade and a small voltage blade of a corresponding and mating multi-prong polarized plug. The invention also applies to older plugs and three-blade plugs where both the neutral and voltage blades are the same width. In one embodiment, insertion of the multi-prong polarized plug depresses the exterior lobes of two separate cams, which work together to change the normally open circuit receptacle of the present invention to a closed circuit receptacle. In order for both cams to be activated, the mating multi-prong polarized plug must be inserted almost completely into the plug receptacle before the electrical circuit is closed, thereby supplying current to the plug. The neutral prong must be at least the width of the voltage prong to close the circuit.

U.S. Pat. No. 5,928,019 Chen, et al.

This is a safety socket for avoiding danger of shock due to insertion of alien article into the insertion hole. The socket includes two high and two low fixing seats. Two insulative slide boards are reversely disposed on the fixing seats side by side. The lower edge of each slide board is disposed with an elliptic slot for a pin member to pass there through, whereby the slide boards can be limitedly left and right slided. The socket further includes two long and two short leaf springs. The short leaf springs abut against front edges of the slide boards. The long leaf springs are fixed on inner walls of a housing of the socket opposite to the short leaf springs. The long and short leaf springs are disposed with convex contact points opposite to each other. When a plug is not inserted into the socket, the slide boards are pushed by the resilient force of the short leaf springs to the center of the socket away from the long leaf springs so as to open the circuit. While when the plug is inserted into the socket, the contact points of the long and short leaf springs contact with each other to close the circuit.

All of the safety receptacle patents herein referenced use various mechanical means such as springs, levers, slides, cams, roller switches, or plungers to close normally open switches.

Lin for example uses a set of four coordinated switches that are activated by the action of the blades of the male plug. Any combination of activated switches other than all four switches would result in a failure to energize the female conductive elements.

Projkovski also uses a combination of four switches oriented and wired in a slightly different manner. In Projkovski's device, two of the switches are normally closed and two are normally open with the normally open switches place above the slots, and the normally closed switches placed below the slots. It is only by contact with the normally open switches that the circuit will be energized.

Mortun uses a different mechanical approach that relies on a normally closed switch to deenergize the circuit. The switch can only be opened by the action of the male plug being inserted into the slot and pressing on the sliding cover of the arm of the switch. The slide when depressed opens the normally closed switch allowing the rest of the circuit to be energized. Mortun is providing an alternative path for the current to flow through until the switch is opened.

Chevarie uses a set of transverse springs to position actuating devices that extend partway into the passage reserved for the prongs of the corresponding male plug. When a male plug is inserted into the passageway the actuating devices are depressed against the springs, which push against the conducting elements to energize the circuit.

Norling's device uses a set of outer switches connecting wires and a set of inner switches. Activation of the outer switches by partial insertion of an object will not cause a circuit closed condition only full insertion that activates the outer pair of switches and then the inner switches will result in circuit activation.

The Flint device uses both a set of springs and a set of rotating cams. Insertion of an object into the receptacle slot displaces the front lobe of the cam causing the rear lobe of the cam to press against a spring-loaded contact that energizes the opposite female element preventing accidental electrocution Allison's device is similar in concept to Flint's except for the depth of the placement of the rotating cams. Allison places the cams near the terminal end of the pathway reserved of the prongs of the male plug requiring the plug to be almost fully inserted prior to activation of the circuit.

Chen uses a different approach with the circuit constantly energized, but access to the circuit is prohibited by use of two insulated spring loaded slide boards to cover the opening of the receptacle. The slid boards are equipped with a pin slot that allows for the slide boards to move laterally when activated by a properly configured male plug.

Each of the above inventions tries to accomplish an electrically safe wall receptacle by using various mechanical means to activate a normally deenergized circuit. The use of slides, springs, levers, cams, and springs are all valid, but limited in the effectiveness of their intended function.

Specifically, the critical strength of all these mechanical devices is also their critical weakness. Numerous experiments have revealed a direct proportional relationship between the speed [or time] of contact closure and the intensity of an electrical arc; the faster the closure, the less intense the electrical arc, conversely, the slower the closure the greater the arc. Thus, all previously referenced devices rely upon the speed of the insertion of the male plug to control the intensity of the electrical arc. Finally, degradation of the mechanical means used is another inherent weakness of all the previously referenced mechanical devices.

Other patents considered relevant and included by reference:

| | |
|---|---|
| U.S. Pat. No. 5,865,635 | Hsiang |
| U.S. Pat. No. 5,374,199 | Chung |
| U.S. Pat. No. 5,320,545 | Brothers |
| U.S. Pat. No. 5,256,076 | Hamlin |
| U.S. Pat. No. 5,186,639 | Comerci |
| U.S. Pat. No. 5,113,045 | Crofton |
| U.S. Pat. No. 5,069,632 | Avitan |
| U.S. Pat. No. 4,927,373 | Dickie |
| U.S. Pat. No. 4,853,823 | Arechavaleta |
| U.S. Pat. No. 4,758,696 | Grazer |
| U.S. Pat. No. 4,179,175 | Farnworth |
| U.S. Pat. No. 4,152,557 | Busch et al |
| U.S. Pat. No. 4,148,536 | Petropoulsos |
| U.S. Pat. No. 4,093,336 | Rose |
| U.S. Pat. No. 4,008,403 | Rose |
| U.S. Pat. No. 3,942,856 | Mindheim |

SUMMARY OF THE INVENTION

In one preferred embodiment of this invention the receptacle in its normal unused state would be connected to the electrical power circuit through a relay that is normally open. The relay is controlled by a strategically placed sensor on the face of the receptacle situated in the general area that lies between the two vertical openings. The sensor may be any of a range of sensors such as infrared, capacitive proximity, heat or light detecting, or the newer smart sensors that have the capability of additional functions beyond the normal sensing capabilities. With 120 vac applied to one side of the normally open relays, and the sensor controlling the return path, the receptacle is electrically safe, that is no current is flowing, until the sensor detects a cooperating male plug being inserted into the receptacle. If the sensor is not completely covered, or in the case of a heat detecting sensor detects a temperature in excess of the ambient temperature, the relay remains open and will not conduct electricity. If the sensor detects the insertion of a cooperating male plug with no deviation of the temperature set point, it will energize the coils that control the relays causing them to close and allow for the flow of electrical current. Using sensors and relay switches reduces the time for the switches to close to the area of microseconds. It is the fast closing time of the relays that prevents arcing and the subsequent degradation of the relay contacts. The additional advantage of using relays mounted on the back of the receptacle is the ease of replacement in the event of failure. Simply remove the old relay from its socket and plug in a new one.

It is therefore the object of this invention to provide a novel and improved electrically safe receptacle for the prevention of accidental electrocution in a cost effective manner that utilizes a sensor controlled micro electronic circuit to control the energizing of the conductive female elements of the receptacle.

It is a further object of this invention to provide a novel and improved electrically safe receptacle that is backwardly compatible with existing electrical receptacle housing said receptacle may be either a single or duplex receptacle.

It is a further object of this invention to provide an electrically safe receptacle having normally open switched power circuits to reduce and prevent accidental electrocution resulting from insertion of conductive foreign elements into the receptacle.

In another preferred embodiment of this invention GFIC technology may be connected to the electrically safe receptacle between the relays and the conductive female elements of the receptacle to provide additional safety in the event that the apparatus being operated is defective. The detection of a differential current between the hot leg and the neutral leg for any reason will cause the GFI to trip open the circuit.

BRIEF DESCRIPTION OF THE DRAWINGS

This invention can best be understood by reference to and in connection with the accompanying drawings which describe the device in great detail.

DETAILED DESCRIPTION OF THE INVENTION

Figure 1:
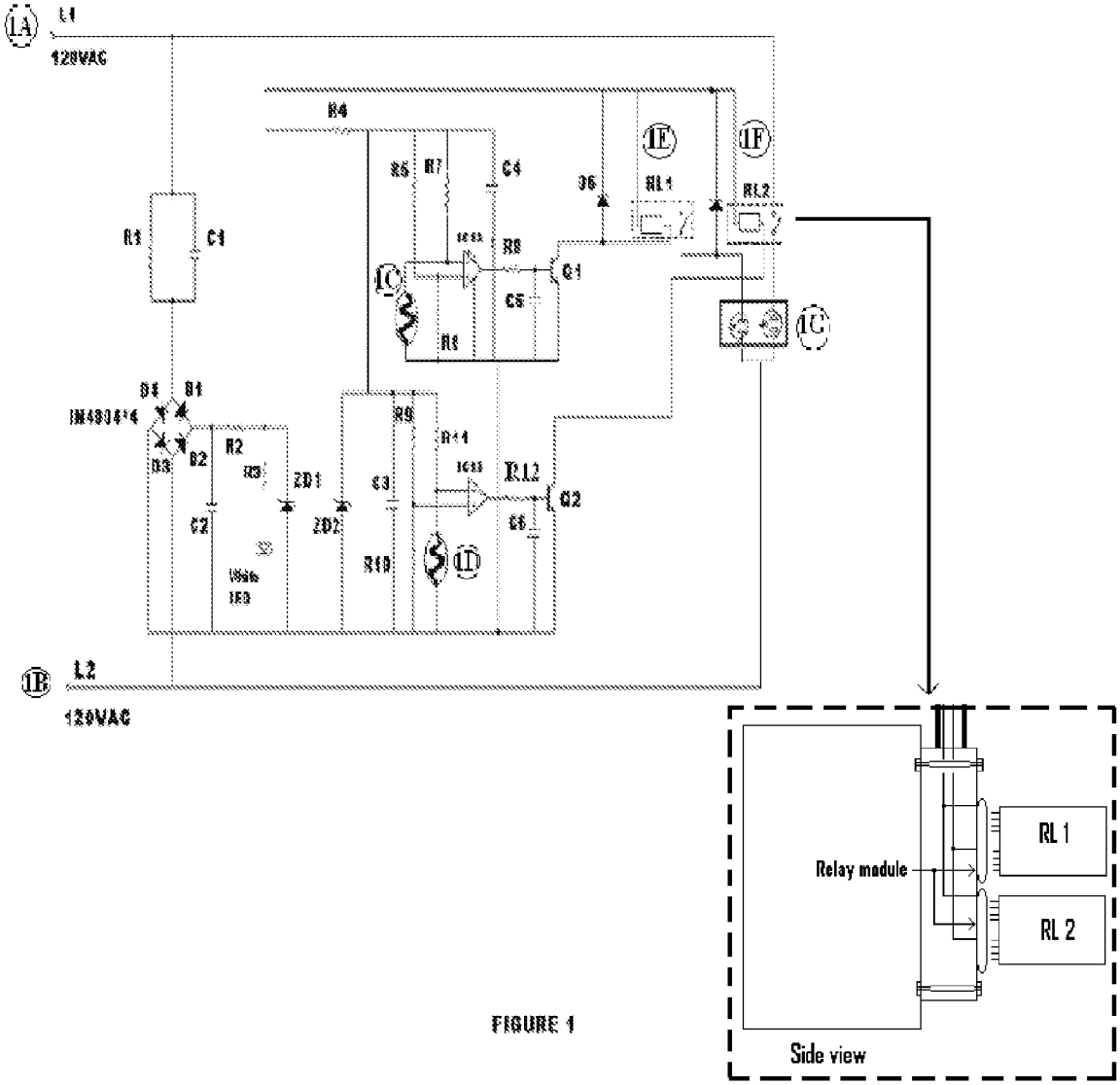
FIG. 1 is a schematic representation of one of the preferred embodiments showing the sensor and printed circuit board that controls the energizing of the female conductive elements.

FIG. 1 shows the 120 VAC connection 1A is applied to one side of 1E and 1F the normally open independent switches and controlled by activation of the corresponding coil associated with each switch. 1A is also connected to one side of the corresponding coils of 1E and 1F. Insertion of a proper male corresponding plug into 1G will activate sensor 1C. When sensor 1C is activated, a return path is provided for the coil on 1E. When the coil on 1E is energized, it pulls closed the corresponding switch energizing the conductive female elements on one side of plug 1G allowing the electrical appliance to operate. Removal of the corresponding male plug deenergizes sensor 1C which removes the return path for coil 1E allowing the corresponding switch to open and remove electrical current from the female elements of plug 1G.

Figure 2:
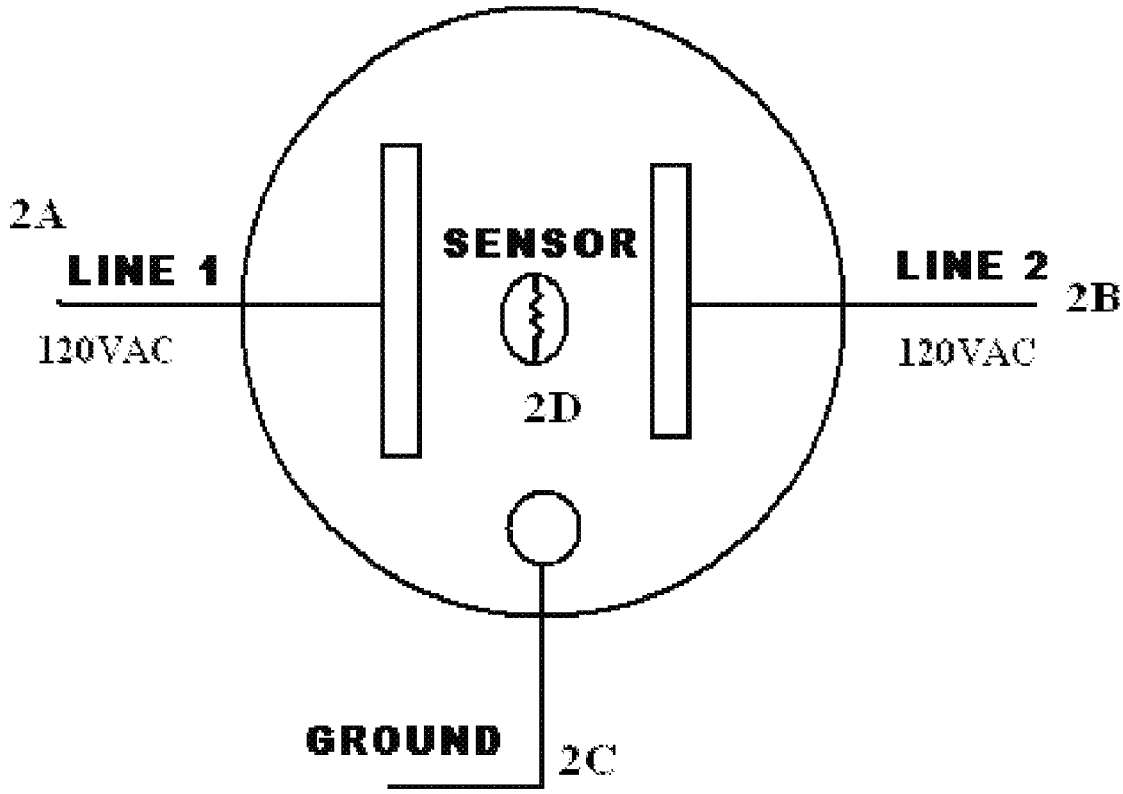
FIG. 2 shows one preferred embodiment of the face of the electrically safe receptacle with strategically place sensors for the detection of a cooperating male plug.

FIG. 2 shows face of a sensor equipped electrically safe receptacle in one preferred embodiment of this invention. 2A is the longer hot element configured in an identical manner to the currently used electrically "hot" receptacles. 2B would be the normal return path element while 2C is the third wire grounding element in a traditional three wire configuration. 2D shows the placement of the control sensor in one preferred embodiment of this invention.

It is therefore to be understood that various changes may be made in the method and means and apparatus of the present invention, as well as it's intended application and use without departing from the spirit and scope of the present invention as defined by the following claims.

What is claimed:

1. A safe electrical wall receptacle that provides power only to a properly configured and inserted male plug comprising: a receptacle with a front face, and a back face sized and formed in the shape of a standard electrical wall socket with at least three passages on the front face side; two oblong vertically oriented openings and one semi-circular opening disposed below and equidistant from the vertically oriented slots sized and defined for receiving metallic prongs of a cooperating male appliance plug; further comprising two conductive elements disposed within the vertically oriented openings, one power and one neutral return path, and one non-conductive grounding element disposed with in the semi-circular opening; further comprising a normally open modular relay switch housed in a separate housing and attached to the back face of the receptacle and the means to connect conductive side of the normally open relay switch to a power source; further consisting of a single sensor means positioned on the face of the receptacle between and equidistant from the vertically oriented openings to only detect the presence of a fully inserted male plug said sensor means being wired in series with the normally open relay switch.

2. A safe electrical wall receptacle as claimed in claim 1 where a fully inserted male plug is the only means to activate the sensor means.

3. A safe electrical wall receptacle as claimed in claim 1 where the sensor means detects the presence of a properly inserted male plug and outputs a voltage to the coil terminals associated with the normally open relay switch causing said switch to close conductively coupling the power source to the conductive elements disposed within the open cavities.

4. A safe electrical wall receptacle as claimed in claim 1 where the sensor means may be a proximity sensor, an infrared sensor, or a photosensitive sensor.

5. A safe electrical wall receptacle as claimed in claim 1 wherein the normally open relay switch base is affixed to the back of the receptacle is a modular plug-in type with means to attach said base to a power source.

6. A safe electrical wall receptacle as claimed in claim 1 comprising the means to hardwire said receptacle to all current residential and commercial power distribution systems.

* * * * *